United States Patent [19]

Ibrahim

[11] 4,341,081

[45] Jul. 27, 1982

[54] MULTIBAND OPEN FRONT REFRIGERATED CASE WITH AIR DEFROST

[75] Inventor: Fayez F. Ibrahim, Niles, Mich.

[73] Assignee: Tyler Refrigeration Corporation, Niles, Mich.

[21] Appl. No.: 70,882

[22] Filed: Aug. 29, 1979

Related U.S. Application Data

[63] Continuation-in-part of Ser. No. 11,804, Feb. 14, 1979.

[51] Int. Cl.[3] ..... F25D 21/12

[52] U.S. Cl. ..... 62/82; 62/256; 62/255; 62/151

[58] Field of Search ..... 62/256, 255, 151, 82, 62/282

[56] References Cited

U.S. PATENT DOCUMENTS

| | | | |
|---|---|---|---|
| 3,094,851 | 6/1963 | Beckwith | 62/256 |
| 4,026,121 | 5/1977 | Aokage et al. | 62/256 |
| 4,144,720 | 3/1979 | Subera | 62/256 |

FOREIGN PATENT DOCUMENTS

| | | | |
|---|---|---|---|
| 2804008 | 8/1978 | Fed. Rep. of Germany | 62/256 |

*Primary Examiner*—Albert J. Makay
*Assistant Examiner*—Henry Bennett
*Attorney, Agent, or Firm*—LeBlanc, Nolan, Shur & Nies

[57] ABSTRACT

An open front refrigerated display case having mechanisms for establishing an inner refrigerated air band encircling the display portion of the case and secondary air band also encircling the display portion and being positioned outside of the inner air band. An inner air conduit passes around the cabinet of the display case and has an outlet opening at one end of the access opening in the front of the cabinet and an inlet opening at the other end of the front access opening in the cabinet. A fan circulates air through this inner air conduit with the air leaving the outlet opening and being directed toward and received by the inlet opening of the conduit, thereby establishing an inner air band along with an inner air curtain across the access opening in the front of the cabinet. An evaporator coil arranged within the inner air conduit serves to refrigerate the air passing along the inner air band during a refrigeration cycle of operation. A secondary air conduit surrounds the inner air conduit within the cabinet and during a refrigeration cycle carries air which is cooler than ambient air, but unrefrigerated. A second fan is provided within this secondary air conduit for circulating air through the conduit and establishing a secondary air band and secondary curtain across the opening in the front of the cabinet. During a defrost cycle of operation, the evaporator coil is turned off and the direction of air flow through the inner air conduit is reversed and unrefrigerated air is caused to pass through the inner air conduit, thereby serving to defrost that conduit. During the defrost operation, the air flow through the secondary air conduit is either turned off or reversed in its flow direction.

22 Claims, 4 Drawing Figures

MULTIBAND OPEN FRONT REFRIGERATED CASE WITH AIR DEFROST

RELATED APPLICATION

The present application is a continuation-in-part of my copending application Ser. No. 11,804 filed Feb. 14, 1979 which is entitled OPEN TOP MULTIBAND REFRIGERATED DISPLAY CASE. This copending application is assigned to the same assignee as the present application. Such copending application is hereby incorporated by reference.

BACKGROUND OF THE INVENTION

The present invention relates to open front refrigerated display cases having an ambient air defrost system. Both within the specification and the claims of the present application, all references to refrigeration apparatus or refrigeration operations are intended to include cooling both at a temperature below 32° F., such as associated with frozen food display cases, and in excess of 32° F., such as typically associated with dairy food and fresh meat display cases.

In the operation of all types of refrigerated display cases, it is desirable to include a system capable of automatically defrosting the display case. The defrost cycle can be actuated either at set periodic times or when the frost buildup within the system has reached a certain predetermined level. Such systems are typically thermostatically controlled so as to switch from a refrigeration cycle to a defrost cycle of operation. By this manner of operation, it is possible to avoid any significant frost buildup within the display case.

Typically within the prior art, there have been three different approaches employed for defrosting refrigerated display cases. The first approach involves the use of electric resistance heaters that are arranged adjacent to the refrigeration coils of the refrigeration mechanism. During a defrost cycle, these heaters supply heat in an effort to eliminate the frost buildup on the coils but also adds warmer air to the air conduit for circulation within the case. The particular technique is relatively simple both in its construction and operation. The electrical heaters are high wattage heaters, however, and thus utilize significant electricity during operation. Furthermore, the warm air circulated in the case can raise the temperature of the case too high. Thus, attempts have been made to find other alternatives to such system.

A second type of system circulates compressed gaseous refrigerant through the refrigeration coils during the defrost cycle. During the defrost cycle, a valve control mechanism shuts off the supply of refrigerant to the refrigeration coils and alternatively feeds compressed gaseous refrigerant through the coils. While this gas serves to reduce any frost buildup that has occurred on the refrigeration coils, it simultaneously provides heat within the air conduit which can be circulated through the display case, which again is disadvantageous. Due to the requirement that the system be able to selectively switch between the supply of gas and refrigerant to the refrigeration coils, a complicated valving structure must be provided.

The third type of system employed for defrosting display cases relies upon ambient air. It is this general category with which the invention of the present application is concerned. One type of system that employs ambient air during the defrost cycle is exemplified by those embodiments illustrated in U.S. Pat. Nos. 3,403,525, 3,850,003 and 3,937,033, all to Beckwith, et al. Each of these systems use fans separate from the main air circulating fans. These extra fans are turned on during the defrost cycle for pulling ambient air from outside of the display case into the air conduits. A second type of system is illustrated in U.S. Pat. No. 3,082,612 to Beckwith, which system draws ambient air into the main circulation path through ports located in the lower front panel of the refrigerated display case. Such ports are normally closed during the refrigeration cycle and are opened during the defrosting cycle. The Beckwith, et al. 3,850,003 patent indicates that the concepts described in patent Nos. 3,082,612 and 3,403,525 did not prove to be practical and hence were not commercially feasible.

Finally, a third type of ambient air defrosting system is shown in U.S. Pat. No. 4,144,720 to Subera, et al., which is assigned to the same assignee as the present application. In the foregoing patent, an open front refrigerated display case having primary and secondary air conduits is disclosed. In this system, reversible fans are employed for reversing the direction of flow of air within the conduits and simultaneously drawing in air from outside of the display case.

Other systems employing reversible fans for ambient air defrost are shown in U.S. Pat. No. 4,026,121 to Aokage and U.S. Pat. No. 4,120,174 to Johnston. The Aokage patent, however, refers to an open front display case in which the air flow between the primary and secondary air bands is short-circuited for the purpose of supplying warmer air to the primary band. The Johnston patent illustrates an open top display case having only a single air band.

SUMMARY OF THE INVENTION

An object of the present invention is to provide a multiband open front refrigerated display case having an improved ambient air defrost system.

Another object of the present invention is to provide an open front refrigerated display case having substantial operational advantages as compared to previously known systems.

A further object of the present invention is to provide an open front refrigerated display case having an ambient air defrost system having an improved efficiency of operation as compared to previously known systems.

A still further object of the present invention is to provide a multiband open front refrigerated display case, wherein during a defrost cycle of operation ambient air is circulated in a reverse direction through both the inner air conduit, in which the refrigeration mechanism is located, and the secondary air conduit.

A still further object of the present invention is to provide a multiband open front refrigerated display case in which during a defrost cycle of operation the flow of air through the inner air conduit is reversed and the air flow through the secondary air conduit is temporarily terminated.

These objectives are achieved by the provision of a multiband open front refrigerated display case in accordance with the present invention. In all of the embodiments of the open front display cases in accordance with the present invention, the cases have inner and secondary U-shaped air conduits that extend along the top, rear and bottom walls of the cabinet of the display case. The secondary conduit lies outside of the inner air conduit. Both the inner and secondary air conduits have air outlet and air inlet openings, which are disposed at opposing sides of the opening in the front wall of the display case. The air outlets and inlets are arranged so that air leaving the outlet from each of the conduits will be directed towards and received by the corresponding inlet of the same conduit. Thus, by circulating air through the conduits, air curtains are established across the access opening in the front of the display case and air bands are established. During a refrigeration cycle of operation of the display case, the air circulated through the inner air conduit is refrigerated by an evaporator coil or a set of evaporator coils arranged within such conduit. While the air circulated through the outer, secondary air conduit during a refrigeration cycle of operation is not refrigerated, such air is typically cooler than ambient air. Inasmuch as the inner and secondary air conduits share a common wall, the conduits are in a heat exchanging relationship and the air passing through the secondary air conduit will be cooled.

In such multiband open front display cases, the inner air band of refrigerated air that is established serves to refrigerate the products displayed within the case. The secondary band of unrefrigerated but cool air serves as a barrier for protecting the inner refrigerated air band. Thus, the secondary air curtain formed by the secondary air band prevents ambient air from outside of the display case from entering and mixing with the inner air curtain of refrigerated air in the area of the opening in the front of the display case. As a further barrier for the protection of the refrigerated air, a third, ambient air curtain can be directed across the access opening in the display case. This ambient air curtain lies outside of the secondary air curtain and conducts air from the top of the display case to a location just outside of the bottom of the display case. The third conduit only extends from the top of the display case to a location adjacent to the outlet openings of the inner and secondary conduits.

During the defrost cycle of operation of such a multiband open top refrigerated display case, ambient air is circulated through the inner air conduit which serves to defrost the evaporator coil or coils within such conduit, along with eliminating frost buildup on any other elements within that conduit. During the defrost cycle as the ambient air is circulated through the inner air conduits, the refrigeration mechanism is deactivated. In order to cause the ambient air to be circulated through the inner air conduit, the flow direction of air through the inner and secondary air conduits is reversed and ambient air is drawn into the conduits. Alternatively, the air flow through the secondary conduit is terminated and the flow through the inner conduit is reversed. In this manner, the temperature of the air flowing through the inner air conduit is increased, so as to carry out the defrosting operation.

With either type of embodiment, the direction of ambient air flow through the third conduit can be maintained. During the defrost operation the ambient air flow can be drawn into either or both the reverse air flows through secondary and inner air conduits.

When the air flow through the inner and secondary air conduits is reversed during a defrost cycle of operation, the air is expelled from the conduits through the inlet openings and such air is directed away from the display case. Thus, there is effectively no air curtain across the opening in the front of the display case. Since the fans are still drawing air into the conduits, a partial vacuum is created in the area of the outlet openings in such conduits, thereby causing ambient air from outside of the display case to be drawn into such conduits. Such ambient air is then circulated through the conduits for defrosting the elements within such conduits, in particular, for defrosting the evaporator coils in the inner air conduit.

DESCRIPTION OF THE PREFERRED EMBODIMENTS

Figure 1:
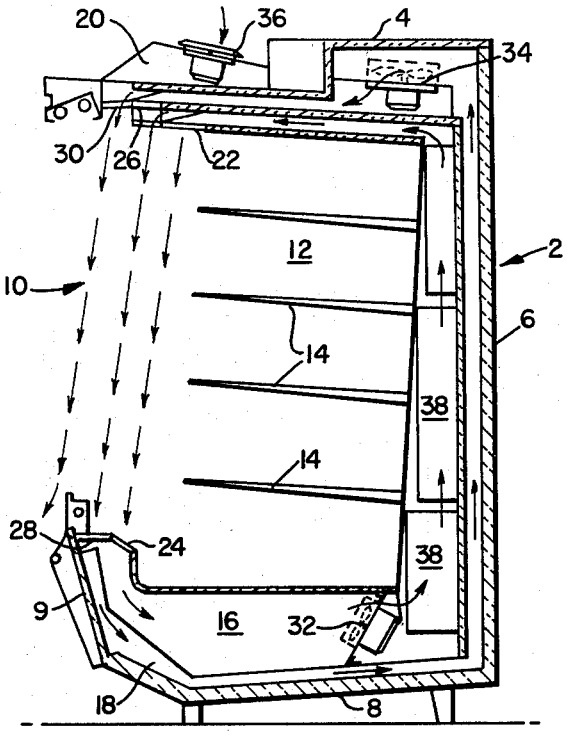
FIG. 1 is a side elevational sectional view of a refrigerated display case in accordance with the present invention during the refrigeration mode of operation.

Refrigerated display case 2, as shown in FIG. 1, has a top wall 4, a rear wall 6, a bottom wall 8 and a front wall 9. Located within the front wall is a front access opening 10. In the interior 12 of display case 2, there are arranged a plurality of shelves 14. These shelves serve to hold the various products to be displayed within the refrigerated display case.

Two approximately U-shaped conduits 16 and 18 encircle the display case extending along top wall 4, rear wall 6 and bottom wall 8. Air conduit 16 is the primary, refrigerated air conduit and contains refrigeration coils 38. Conduit 16 has an outlet opening 22 located at the top end of access opening 10 and an inlet opening 24 located at the bottom end of access opening 10. During the refrigeration cycle of operation, air is circulated through conduit 16 by one or more fans, such as fan 32. The number of fans actually utilized depends on the length of the refrigerated case, the size of the fans and the temperature level to which the case is to be cooled. This air passes along conduit 16 through refrigeration coils 38 where the air is cooled. The refrigerated air is then expelled from conduit 16 through outlet opening 22 so as to be directed across access opening 10. As the refrigerated air passes across access opening 10, a refrigerated air curtain is formed across the opening. Outlet opening 22 and inlet opening 24 are aligned so that the air expelled from outlet opening 22 is directed toward and received by inlet opening 24. Thus the refrigerated air is returned to air conduit 16 for recirculation.

Surrounding air conduit 16 is a secondary air conduit 18. Air conduit 18 has an outlet opening 26 and an inlet opening 28. These openings are in alignment so that air emitted from the conduit through outlet opening 26 is directed toward and received back into the conduit through inlet opening 28. Thus the air is recirculated so as to form a secondary air band with a secondary air curtain. The air is circulated through secondary conduit 18 by one or more fans such as fan 34. The number of fans actually utilized depends on the length of the display case and the sizes of the fans.

Since the secondary and primary conduits share a common wall, the air passing through the secondary conduit is cooled by the refrigerated air circulated through the primary conduit by a heat exchange process. During the refrigeration cycle operation, air conduit 18 carries air which is cooler than ambient air although not refrigerated.

The air flow directions created by the air circulated through the primary and secondary conduits are shown in FIG. 1. As can be seen, the refrigerated air curtain is established by the air leaving outlet opening 22 and reentering inlet opening 24. This refrigerated air curtain serves to help refrigerate the products within the interior 12 of display case 2. The secondary air curtain that is formed by the air leaving outlet opening 26 and reentering inlet opening 28 serves to protect the refrigerated air curtain from the ambient air outside of the display case. As a further protective barrier, a tertiary curtain of ambient air can be formed outside of the secondary air curtain.

The tertiary ambient air curtain is formed by air directed through conduit 20 so as to be expelled from outlet opening 30. The air leaving outlet opening 30 passes along the front of the display case and falls at a location outside of front wall 9 so as to be directed to the floor. The air is propelled through conduit 20 by one or more fans such as fan 36. Fan 36 draws in ambient air from outside of the display case and propels it through conduit 20. The ambient air curtain serves to protect both the inner and secondary air curtains during a refrigeration mode of operation such as represented by the arrows in FIG. 1.

During the refrigeration operation of the display case, there is a buildup of condensation and frost on the refrigeration coils. As this buildup of frost continues, the passages through the refrigeration coils become either partially or totally blocked. Consequently, at periodic points of the operation of the display case, it is necessary to defrost refrigeration coils 38. The defrost cycle operation can occur either on a set periodic time basis or based on the amount of frost buildup on the coils.

During the defrost cycle operation, refrigeration coils 38 are temporarily deactivated so that the air passing through conduit 16 is no longer refrigerated. In addition, the direction of the air flow through conduit 16 is reversed such as shown by the arrows in FIG. 2. In accordance with a first type of defrost operation of the present invention, the air flow through secondary air conduit 18 is simultaneously reversed so that the air flows through both conduits 16 and 18 are in the same direction. With such reverse air flows, air is drawn into the outlet openings at the top of access opening 10, circulated through the conduits and then expelled from the inlet openings at the bottom of access opening 10. For enabling such reverse air flows, fans 32 and 34 can be reversible fans.

Figure 2:
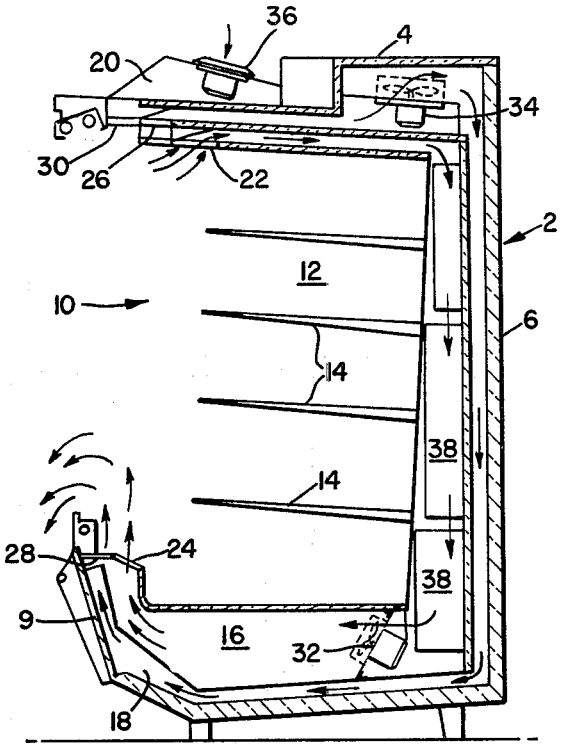
FIG. 2 is the refrigerated display case shown in FIG. 1 during a first type of defrost mode of operation in accordance with the present invention.
Figure 3:
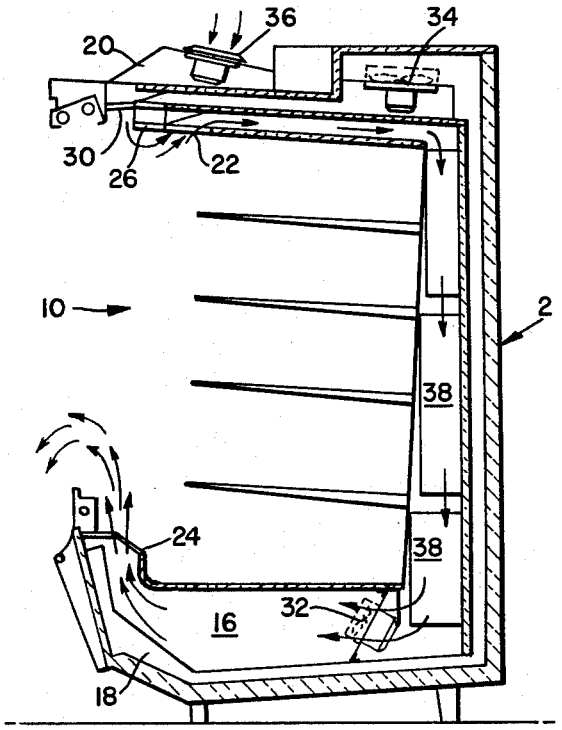
FIG. 3 is another view of the display case illustrated in FIG. 1 during the second type of defrost operation in accordance with the present invention.

Due to the configuration of the inlet openings 24 and 28, the air that is expelled from those openings during a defrost mode of operation is directed away from the display case, such as shown by the arrows in FIG. 2 and hence, there is no air curtain across access opening 10. Consequently, other air must be drawn into the outlet openings 22 and 26. The air that is drawn into these outlet openings so as to be circulated through conduits 16 and 18 is ambient air. Such ambient air can be drawn from the air expelled from conduit 20 through outlet opening 30. Thus, the ambient air leaving the tertiary conduit is drawn into both inner conduit 16 and secondary conduit 18 so as to be circulated through those conduits. This ambient air serves to defrost refrigeration coils 38 and the interiors of conduits 16 and 18.

In accordance with a second type of defrost operation of the present invention, instead of reversing the air flow through conduit 18, fan 34 can merely be turned off so that there is no air flow through the conduit. In this situation, the direction of air flow through conduit 16 is still reversed and is expelled through inlet opening 24 in a direction away from the display case. The ambient air expelled from conduit 20 through outlet opening 30, however, is drawn only into conduit 16 so as to be circulated through such conduit.

Figure 4:
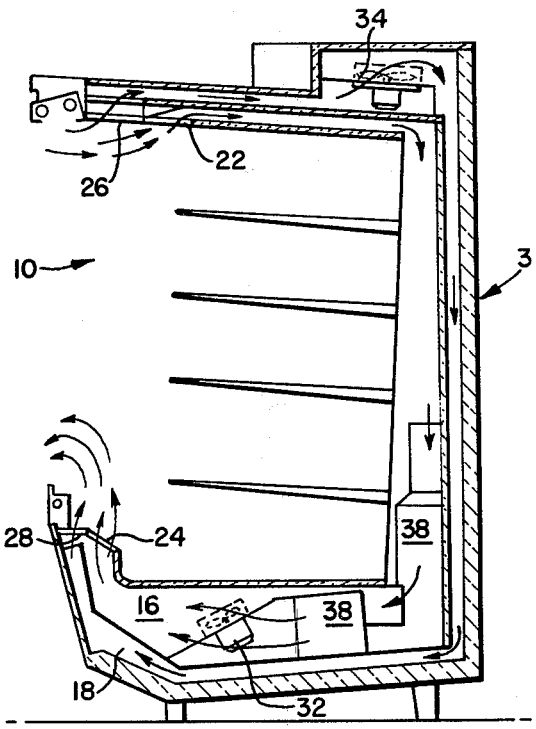
FIG. 4 is a side elevational sectional view of a modified embodiment of a refrigerated display case in accordance with the present invention during the defrost mode of operation.

In accordance with a modified embodiment, tertiary conduit 20 along with its fan 36 can be eliminated. Accordingly, refrigerated display case 3, as shown in FIG. 4, only has two air conduits, inner air conduit 16 and secondary air conduit 18. The operation of this display case during the refrigeration mode of operation is the same as display case 2 shown in FIG. 1, as discussed above, except that the tertiary air curtain is removed. During the defrost mode of operation of display case 3, instead of air being drawn into outlet openings 22 and 26 from the ambient air expelled from conduit 20, ambient air is drawn into these outlet openings from the air surrounding the outside of the display case, such as shown in FIG. 4. In all other respects, the operation of display case 3 is the same as either of the alternative operations of display case 2.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. A method of operating an open front refrigerated display case where the display case includes:

a cabinet having top, rear, bottom and front walls and an opening within the front wall for enabling access to products displayed within the display case; an inner air conduit passing around the top, rear and bottom walls of the cabinet and having a first air outlet opening adjacent one end of the opening in the front wall of said cabinet and a first air inlet opening adjacent the other end of said opening in said front wall of the cabinet with the first air outlet and the first air inlet being aligned so that air leaving the first outlet is directed towards and received by the first air inlet; and a secondary air conduit passing along the top, rear and bottom walls of the cabinet and being arranged adjacent to the inner air conduit but outwardly therefrom and having a second air outlet opening adjacent one end of the opening in the front wall of the cabinet and a second air inlet located adjacent the other end of the opening in the front wall of the cabinet with the second air outlet and the second air inlet being aligned so that air leaving said second air outlet is directed towards and received by the second air inlet; said method comprising the steps of:

circulating air through the inner air conduit in a forward direction during a refrigeration cycle of operation so as to establish an inner air band and an inner air curtain across the opening in the front wall of the cabinet;

cooling air passing through the inner air conduit only during a refrigeration cycle of operation of the display case;

circulating air through the secondary air conduit in a forward direction during a refrigeration cycle of operation so as to establish a secondary air band with a secondary air curtain across the opening in the front wall of the cabinet;

turning off said refrigeration means during a defrost cycle;

terminating the forward air flow through said secondary air conduit during a defrost cycle; and reversing the air flow direction of said first air circulating means during a defrost cycle to draw relatively warm ambient air into said inner air conduit as the primary defrost medium and passing said ambient air over said refrigeration means to defrost said refrigeration means.

2. A method according to claim 1 wherein the direction of air flow through the secondary air conduit is reversed during a defrost cycle; and further comprising the step of drawing ambient air from outside of the display case into the secondary air conduit during a defrost cycle of operation.

3. A method according to claim 1 wherein the air flow through the secondary air conduit is substantially completely terminated during a defrost cycle; of operation.

4. An open front refrigerated display case comprising:

a cabinet having top, bottom, front and rear walls and an opening within said front wall for enabling access to products displayed within said display case;

an inner air conduit passing around said top, rear and bottom walls of said cabinet and having a first air outlet opening adjacent one end of said opening in said front wall of said cabinet and a first air inlet opening adjacent the other end of said opening in said front wall of said cabinet with said first air outlet and said first air inlet being aligned so that air leaving said first outlet is directed towards and received by said first air inlet;

first air circulating means arranged for circulating air through said inner air conduit so as to establish an inner air band and an inner air curtain across said opening in said front wall of said cabinet;

refrigeration means for cooling air passing through said inner air conduit during a refrigeration cycle of operation of said display case and being capable of being turned off during a defrost cycle of operation;

a secondary air conduit passing along said top, rear and bottom walls of said cabinet and being arranged adjacent to said inner air conduit but outwardly therefrom and having a second air outlet opening adjacent one end of said opening in said front wall of said cabinet and a second air inlet located adjacent the other end of said opening in said front wall of said cabinet with said second air outlet and said second air inlet being aligned so that air leaving said second air outlet is directed towards the received by said second air inlet;

second air circulating means for circulating air through said secondary air conduit so as to establish a secondary air band with a secondary air curtain across said opening in said front wall of said cabinet; and control means for turning off said refrigeration means during a defrost cycle and for reversing the air flow direction of said first and second air circulating means to draw relatively warm ambient air into said inner and secondary air conduits during a defrost cycle as the primary defrost medium to defrost said refrigeration means.

5. A display case according to claim 1 wherein during a defrost cycle operation said first and second circulating means draw ambient air from outside of said display case into said inner and secondary air conduits and circulates such ambient air through said air conduits and expels such ambient air in a direction away from said display case.

6. A display case according to claim 5 wherein said first and second air circulating means each includes at least one reversible fan capable of circulating air in either direction through said inner and outer air conduits, respectively, and said control means causes said reversible fans to circulate air in a reverse direction through said air conduits during a defrost cycle.

7. A display case according to claim 1, 5 or 6 further comprising: a third air conduit having a third air outlet opening adjacent to said first and second air outlet openings and being arranged for directing a curtain of air along the front of said display case in a path lying outside of the inner and secondary air curtains and third air circulating means for propelling ambient air along said third air conduit.

8. A display case according to claim 7 wherein said third air circulating means continues to propel ambient air along said third air conduit both during the refrigeration and defrost cycle of operation and during the defrost cycle of operation said second air circulating means draws ambient air from the third air curtain into said secondary air conduit.

9. An open front refrigerated display case comprising:

a cabinet having top, bottom, front and rear walls and an opening within said front wall for enabling access to products displayed within said display case;

an inner air conduit passing around said top, rear and bottom walls of said cabinet and having a first air outlet opening adjacent one end of said opening in said front wall of said cabinet and a first air inlet opening adjacent the other end of said opening in said front wall of said cabinet with said first air inlet being aligned so that air leaving said first air outlet is directed toward and received by said first air inlet;

first air circulating means arranged for circulating air through said inner air conduit so as to establish an inner air band and an inner air curtain across said opening in said front wall of said cabinet;

refrigeration means for cooling air passing through said inner air conduit during the refrigeration cycle of operation of said display case and being capable of being turned off during a defrost cycle of operation;

a secondary air conduit passing along said top, rear and bottom walls of said cabinet and being arranged adjacent to said inner air conduit but outwardly therefrom and having a second air outlet opening adjacent one end of said opening in said front wall of said cab inet and a second air inlet located adjacent the other end of said opening in said front wall of said cabinet with said second air outlet and said second air inlet being aligned so that air leaving said second air outlet is directed towards and received by said second air inlet; said second air inlet being aligned so that air leaving said second air outlet is directed towards and received by said second air inlet;

second air circulating means for circulating air through said secondary air conduit so as to establish a secondary air band with a secondary air curtain across said opening in said front wall of said cabinet; and control means for turning off said refrigeration means, for terminating the air flow through said secondary air conduit, and for reversing the air flow direction of said first air circulating means during a defrost cycle, to draw relatively warm ambient air into said inner air conduit as the primary defrost medium to defrost said refrigeration means.

10. A display case according to claim 9 wherein during a defrost cycle of operation said first air circulating means draws ambient air from outside of said display case into said inner air conduit and circulates such ambient air through said inner air conduit and expels such ambient air in a direction away from said display case.

11. A display case according to claim 10 wherein said first air circulating means includes at least one reversible fan capable of circulating air in either direction through said inner air conduit and said control means causes said reversible fan to circulate air in a reverse direction through said inner air conduit during a defrost cycle.

12. A display case according to claim 9, 10 or 11 further comprising a third air conduit having a third air outlet opening adjacent to the first and second air outlet openings and being arranged for directing a curtain of air along the front of the display case in a path lying outside of the inner and secondary air curtains and third air circulating means for propelling ambient air along said third air conduit.

13. A display case according to claim 12 wherein said third air circulating means continues to propel ambient air along said third air conduit both during the refrigeration and defrost cycles of operation and during the defrost cycle operation said first air circulating means draws ambient air from the third air conduit into said first air conduit.

14. A refrigerated display case comprising:

a cabinet having a display space and an access opening for enabling access to the interior of said display space;

an inner air conduit passing around said display space and having a first air outlet adjacent one side of said access opening and a first air inlet adjacent an opposite side of said access opening;

first air circulating means for circulating air through said inner air conduit and across said access opening between said first outlet and first inlet to establish an inner air band and an inner air curtain in a refrigeration mode;

refrigeration means for cooling air passing through said inner air conduit during the refrigeration cycle of said display case and being capable to being turned off during a defrost cycle of operation;

a secondary air conduit passing around said cabinet adjacent to said inner air conduit but outwardly therefrom and having a second air outlet adjacent one side of said access opening and a second air inlet located adjacent an opposite side of said access opening;

second air circulating means for circulating air through said secondary air conduit and across said access opening between said second outlet and second inlet to establish a secondary air band with a secondary air curtain in the refrigeration mode; and defrost cycle control means, including means for reversing the air flow direction of said first air circulating means during a defrost cycle, and means for terminating the air flow through said secondary air conduit during the defrost cycle, to thereby draw relatively warm ambient air into said inner air conduit in a reverse flow direction during a defrost cycle as the primary defrost medium to defrost said refrigeration means.

15. A display case according to claim 14, wherein, during a defrost cycle of operation, said first air circulating means draws ambient air from outside of said display case into said inner air conduit through said first air outlet and circulates such ambient air through said inner air conduit and expels such ambient air from said first air inlet in a direction away from said display case.

16. A display case according to claim 14 or 15, wherein said first air circulating means includes reversible fan means capable of circulating air in either direction through said inner air conduit and said control means includes means for reversing said reversible fan means to circulate air in a reverse direction through said inner air conduit during a defrost cycle.

17. A display case according to claim 16, further comprising a third air conduit having a third air outlet adjacent to the first and second air outlets and being arranged for directing a curtain of air along the front of the display case in a path lying outside of the inner and secondary curtains and third air circulating means for propelling ambient air along said third air conduit.

18. A display case according to claim 17, wherein said third air circulating means continues to propel ambient air along said third air conduit both during the refrigeration and defrost cycles of operation, and during the defrost cycle operation said first air circulating means draws ambient air exiting from the third air conduit outlet into said first air conduit outlet.

19. An open front refrigerated display case comprising:

an upright cabinet having a display space and a front access opening for enabling access to the interior of said display space;

an inner air conduit passing around said display space and having a first air outlet adjacent the top of said access opening and a first air inlet adjacent the bottom of said access opening;

first air circulating means for circulating air in one direction through said inner air conduit and across said access opening between said first outlet and first inlet to establish an inner air band and an inner air curtain in a refrigeration mode;

refrigeration means for cooling air passing through said inner air conduit during the refrigeration cycle of said display case and being capable of being turned off during a defrost cycle of operation;

a secondary air conduit passing around said cabinet adjacent to said inner air conduit but outwardly therefrom and having a second air outlet adjacent the top of said access opening and a second air inlet located adjacent the bottom of said access opening;

second air circulating means for circulating air in said one direction through said secondary air conduit and across said access opening between said second outlet and second inlet to establish a secondary air band with a secondary air curtain in the refrigeration mode; and defrost cycle control means including means for reversing the air flow direction of said first air circulating means during a defrost cycle, and means for terminating the air flow through said secondary air conduit during the defrost cycle, to thereby draw relatively warm ambient air into said inner air conduit in a reverse flow direction during a defrost cycle as the primary defrost medium to defrost said refrigeration means.

20. A display case according to claim 19, wherein, during a defrost cycle of operation, said first air circulating means draws ambient air from outside of said display case into said inner air conduit through said first air outlet and circulates such ambient air thourgh said inner air conduit and expels such ambient air from said first air inlet in a direction away from said display case.

21. A display case according to claim 18 or 20, wherein said first air circulating means includes reversible fan means capable of circulating air in either direction through said inner air conduit and said control means includes means for reversing said reversible fan means to circulate air in a reverse direction through said inner air conduit during a defrost cycle.

22. A display case according to claim 21, further comprising a third air conduit having a third air outlet adjacent to the first and second air outlets and being arranged for directing a curtain of air along the front of the display case in a path lying outside of the inner and secondary curtains and third air circulating means for propelling ambient air along said third air conduit.

* * * * *

UNITED STATES PATENT AND TRADEMARK OFFICE

CERTIFICATE OF CORRECTION

PATENT NO. : 4,341,081

DATED : July 27, 1982

INVENTOR(S) : Fayez F. Ibrahim

It is certified that error appears in the above-identified patent and that said Letters Patent is hereby corrected as shown below:

Column 7, line 63, change "the" to --and--.

Column 8, line 8, change "l" to --4--;

, line 22, change "l" to --4--;

Signed and Sealed this

*Thirtieth* Day of *August 1983*

[SEAL]

*Attest:*

GERALD J. MOSSINGHOFF

*Attesting Officer*

*Commissioner of Patents and Trademarks*